US006437507B2

(12) United States Patent
Ha

(10) Patent No.: US 6,437,507 B2
(45) **Date of Patent: *Aug. 20, 2002**

(54) HOLLOW CATHODE TYPE COLOR PDP

(75) Inventor: Hong Ju Ha, Kyungsangbuk-do (KR)

(73) Assignee: LG Electronics Inc., Seoul (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/186,330

(22) Filed: Nov. 5, 1998

(30) Foreign Application Priority Data

| | | |
|---|---|---|
| Nov. 7, 1997 | (KR) | 97-58697 |
| Nov. 7, 1997 | (KR) | 97-58698 |
| Nov. 7, 1997 | (KR) | 97-58699 |
| Nov. 28, 1997 | (KR) | 97-63828 |

(51) Int. Cl.[7] ..... H01J 17/49
(52) U.S. Cl. ..... 313/587; 313/584; 313/582
(58) Field of Search ..... 313/582, 581, 313/587, 583, 584, 585, 586, 485, 479; 427/64, 96

(56) References Cited

U.S. PATENT DOCUMENTS

| | | | | |
|---|---|---|---|---|
| 4,339,482 A | * | 7/1982 | Glaser et al. | 438/13 |
| 4,684,543 A | * | 8/1987 | Baudry | 427/96 |
| 4,963,114 A | * | 10/1990 | Andreadakis | 445/24 |
| 5,412,495 A | * | 5/1995 | Kim | 359/88 |
| 5,742,122 A | * | 4/1998 | Amemiya et al. | 313/582 |
| 5,757,131 A | * | 5/1998 | Tsuchiya | 375/582 |
| 5,792,509 A | * | 8/1998 | Lin et al. | 427/64 |
| 6,169,363 B1 | * | 1/2001 | Mori et al. | 313/582 |

FOREIGN PATENT DOCUMENTS

| | | |
|---|---|---|
| JP | 57-212743 | 12/1982 |
| JP | 113948 | 7/1989 |
| JP | 06-060815 | 3/1994 |
| JP | 06-283108 | 10/1994 |
| JP | 08-315734 | 11/1996 |

* cited by examiner

*Primary Examiner*—Nimeshkumar D. Patel
*Assistant Examiner*—Karabi Guharay
(74) *Attorney, Agent, or Firm*—Fleshner & Kim, LLP

(57) ABSTRACT

Hollow cathode type color PDP, is disclosed, including a front panel having an electrode formed on a front substrate, and a first dielectric film and a protection film formed in succession on an entire surface of the electrode, and a rear panel having a second dielectric film formed on a rear substrate to a thickness opposite to the front panel, a well region formed by etching the second dielectric film to a depth, and an address electrode and a fluorescent material film stacked in succession on an inside surface of the well, thereby allowing a larger discharge area in the discharge cell compared to the related art PDP, which improves a luminance.

27 Claims, 6 Drawing Sheets

HOLLOW CATHODE TYPE COLOR PDP

BACKGROUND OF THE INVENTION

1. Field of the Invention

The present invention relates to a color plasma display panel(PDP), and more particularly, to a hollow cathode type color plasma display panel.

2. Background of the Related Art

Being one of luminous devices which use gaseous discharge in each cell in displaying an image, the plasma display panel is in general spot lighted as a display directed to a age of large sized flat display panel and HDTV(High Definition TeleVision), and wall mounting type TV because the PDP is very easy to fabricate a large sized panel and has a fast responsive speed.

FIG. 1 illustrates an entire cell structure of a related art triode surface discharge color plasma display panel.

Referring to FIG. 1, the related art triode surface discharge color plasma display panel is provided with a front substrate 1 for displaying an image, and a rear substrate 2 parallel to, and spaced from the front substrate 1. The rear substrate 2 has a plurality of barriers 3 at fixed intervals on a surface thereof opposite to the front substrate 1. In the color PDP, bonded front, and rear substrate 1 and 2 forms a plurality of discharge spaces separated by the barriers 3.

The panel structure will be explained in detail. There are an address electrode 4 between every barriers 3, a fluorescent material film 5 formed on surfaces of both barriers 3 and the address electrode 4 on the rear substrate 2 in each discharge space, and a plurality of sustain electrodes on the front substrate I opposite to the rear substrate 2 at fixed intervals, alternatively, one being a transparent electrode 6 and the other being a metal electrode 7. The sustain electrodes are formed in a direction perpendicular to a direction of the address electrodes 4, at every crossing of which a discharge cell is formed. The fluorescent material film emits a visible light when a discharge occurs. And, there are a dielectric film 8 on the sustain electrodes for confining a current, a protection film 9 on the dielectric film 8 for protection of the sustain electrodes and the dielectric film 8, and a discharge gas filled in each of the discharge spaces for inducing a Penning effect.

Referring to FIG. 2, a power for driving the PDP is supplied to a driving circuit connected to the metal electrode 7 extended up to pad electrode 10 on the front substrate 1 through a connection wire. As explained before, the discharge space is formed by bonding the front and rear substrates 1 and 2 with Frit seal at a sealing part 20 around the pad electrode 10.

A process of an image display on each discharge cell in the aforementioned triode surface discharge color PDP will be explained.

When both a discharge voltage is supplied to the sustain electrode and an address signal is supplied to the address electrode 4, a writing discharge is occurred in the cell. Then, a sustain voltage for sustaining luminescence is supplied, to cause a sustain discharge between the sustain electrodes, which induces an electric field in the cell, that accelerates electrons present in the discharge gas in a small amount to make collisions onto neutral particles in succession. This collision causes a higher rate ionization of the neutral particles into electrons and ions, converting the discharge gas into a plasma, with an emission of a vacuum ultra-violet (UV) ray. This vacuum UV ray excites the fluorescent material layer, to emit a visible light, which is directed outside of the PDP through the front substrate 1. As a result, each cell sustain luminous for a time period, displaying an image on the PDP.

However, the related art PDP has a problem in that the central bulge of the PDP caused by the high pressure discharge gas filled in the sealed front and rear panels results in a nonuniform discharge voltage in the cell discharge and cracking of sealing.

And, the related art PDP has a very small cell discharge area because a surface discharge is caused by applying a discharge initiation voltage to the sustain electrodes according to the plasma discharge principle. Of course, the cell discharge area can be made larger to some extent by applying a higher discharge initiation voltage to the sustain electrodes. However, the higher discharge initiation voltage causes a higher discharge voltage, with a difficulty in maintaining an internal pressure of the cells and a higher possibility of damage to the fluorescent material layer.

SUMMARY OF THE INVENTION

Accordingly, the present invention is directed to a hollow cathode type color plasma display panel that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the hollow cathode type color plasma display panel includes an electrode in a form of groove formed in a rear substrate for using a hollow cathode counter discharge occurring between electrodes in the rear, and front substrates. That is, the present invention discloses a PDP in which grooves are formed in any one of a substrate, a dielectric film, a metal sheet, a transparent electrode and an address electrode are formed in curved, or arc forms, for using a hollow cathode counter discharge occurred between the electrode on an inside surface of the barrier and an upper electrode.

Moreover, sealing is made between every regions of barriers in bonding the front substrate and the rear substrate, for improving a sealing reliability between discharge cells.

It is to be understood that both the foregoing ,general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. Different from the related art PDP, a PDP of the present invention has a plurality of grooves formed in the rear substrate and an address electrode, a dielectric film, and a fluorescent material layer are formed in the groove, such that walls of the groove form barriers. This subject matter of the present invention can be embodied in different forms as follows.

FIRST EMBODIMENT

Figure 1:
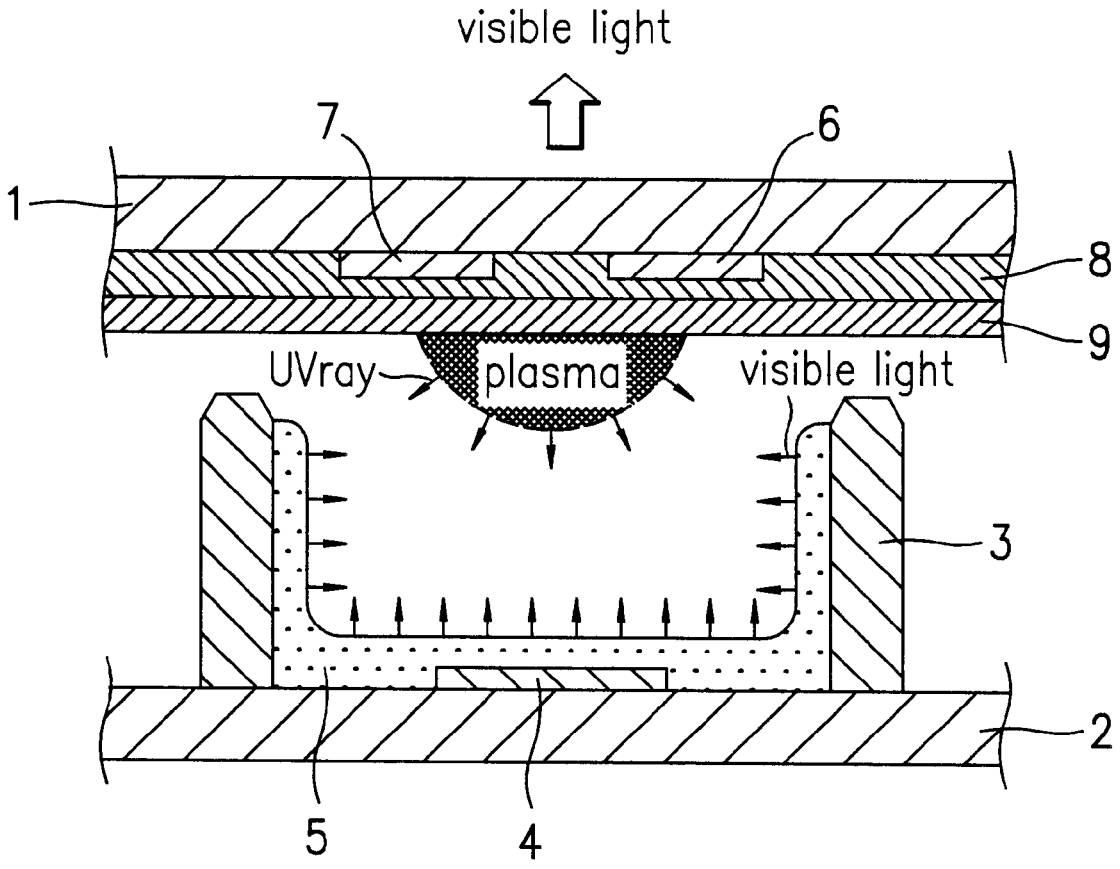
FIG.1 background art
FIG. 1 illustrates an entire cell structure of a related art triode surface discharge color plasma display panel.
Figure 2:
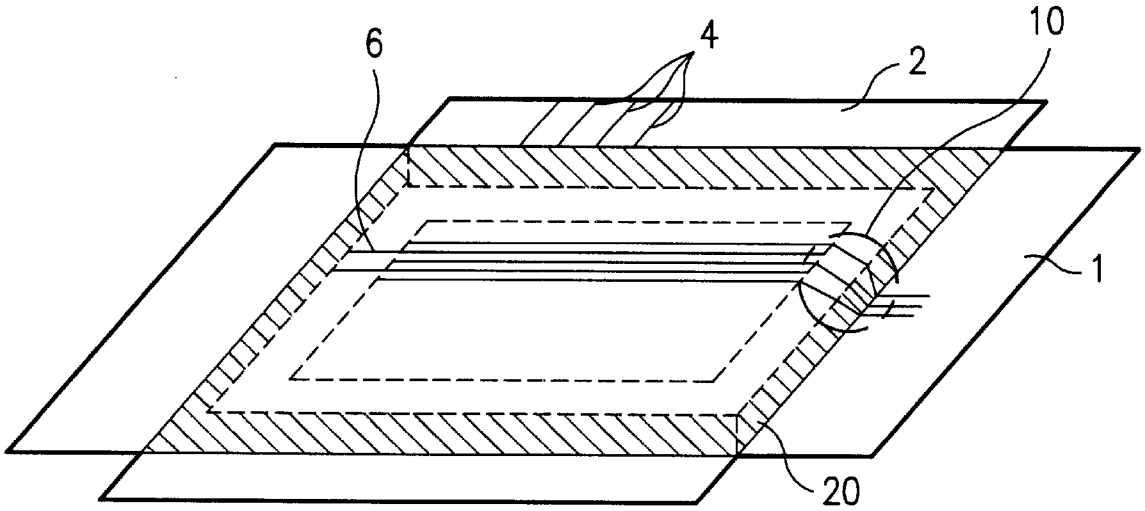
FIG.2 background art
FIG. 2 illustrates the electrode pad shown in FIG. 1.
Figure 3:
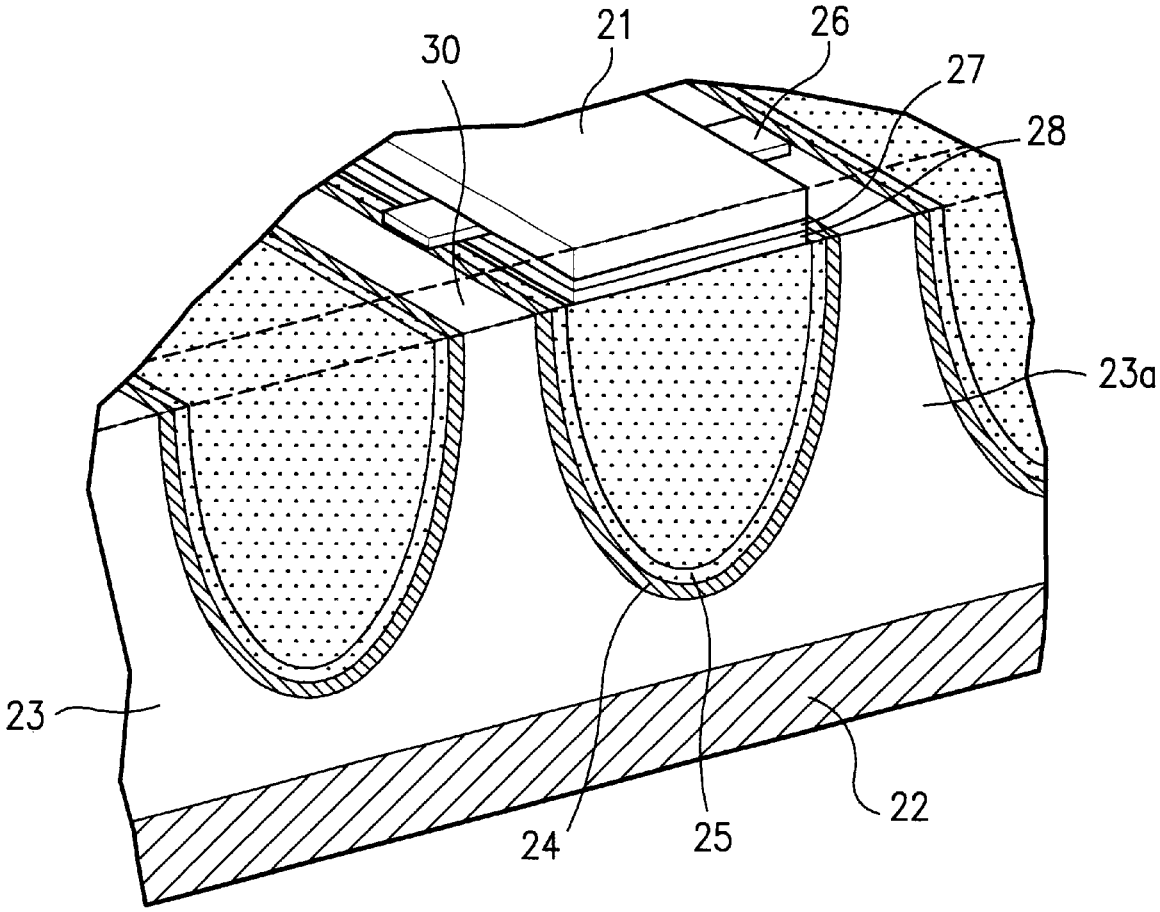
FIG. 3 illustrates a color plasma display panel in accordance with a first preferred embodiment of the present invention.

A hollow cathode counter discharge type color PDP may be embodied in the present intention by etching a dielectric film on a rear panel in an arc form. A color plasma display panel in accordance with a first preferred embodiment of the present invention includes a front panel having electrodes formed on a front substrate and a first dielectric film and a protection film formed in succession on an entire surface of the electrodes, and a rear panel having a second dielectric film formed on a rear substrate to a thickness opposite to the front panel and well regions etched in the second dielectric film to a depth, and an address electrode and a fluorescent material film stacked in succession on an inside surface of the well. In the first embodiment, there is a transparent electrode formed on the front substrate, opposite to which the well region in the second dielectric film on the rear substrate and the address electrode and the fluorescent material film stacked in succession in the well are formed. FIG. 3 illustrates a perspective view of key parts of cells of the hollow cathode type color plasma display panel in accordance with a first preferred embodiment of the present invention, referring to which, the first embodiment will be explained.

Referring to FIG. 3, the hollow cathode type color plasma display panel in accordance with a first preferred embodiment of the present invention includes a front panel having a transparent electrode 26 on a front substrate 21, a first dielectric film 27 on an entire surface of the transparent electrode 26 for confining a discharge current, and a protection film 28 on an entire surface of the first dielectric film. The transparent electrode 26 is formed of indium oxide ($InO_2$) or tin oxide ($SnO_2$) by thin film forming method, dipping method, or screen printing. The first dielectric film 27 provided for generating a wall charge which drops a driving voltage is formed by depositing dielectric paste, and the protection film 28 is formed by depositing magnesium oxide(MgO) on the first dielectric film 27. The second dielectric film 23 is formed together with barriers 23*a* by printing or depositing a dielectric paste on a rear substrate 22 to a thickness and etching the dielectric paste to a depth. If it is required for improving an electric field characteristic and securing a large discharge space in a discharge cell, the thickness of the second dielectric film 23 may be adjusted within a range. The second dielectric film 23 may be formed of a barrier material of a low melting point glass containing lead dioxide($PbO_2$). The address electrode 24 is formed of a metal thin film deposited on an inside surface of the well region and the barrier 23*a* in the second dielectric film 23. The address electrode 24 is formed in a metal on groove form between the barriers 23*a*. The fluorescent material film 25 is coated on an entire surface of the address electrode 24 to a thickness, to complete a rear panel. The fluorescent material film 25 may also be formed by printing a fluorescent material paste composed of cellulose, acrylic resin and organic solvent(alcohol or ester) on a surface of the address electrode 24 and baking at 400 ~600. The fluorescent material film 25 has a thickness of approx. 10~50 $\mu$m.

In the color PDP in accordance with a first preferred embodiment of the present invention, a hollow cathode counter discharge is occurred between the transparent electrode 26 and the address electrode, a target facing the transparent electrode 26. As the color PDP in the first embodiment utilizes a discharge between a transparent electrode 26 and the address electrode 24, ions which can be used in a glow region can be increased.

The principle of the hollow cathode counter discharge employed in the first embodiment is as follows. Upon a discharge initiation voltage is applied to the transparent electrode 26 and the address electrode 24, electrons emitted from the address electrode 24 are activated to form a discharge glow region. These electrons come from collisions of ions over the address electrode 24 and are accelerated outwardly from the glow discharge region to make collisions onto the fluorescent material film 25, to emit an UV ray while the electron are vanished. The UV ray excites the fluorescent material film 25, to emit light, displaying colors of R, G, B. As a result, because the fluorescent material film 25 is excited by the UV ray emitted according to the hollow cathode counter discharge principle, the first embodiment allows to utilize an entire discharge cell as the discharge region. Eventually, a contrast and a luminance of the first embodiment is improved by approx. four times than the related art PDP. And, because the hollow cathode discharge is employed in which the address electrode is used as a counter target, the first embodiment color PDP is involved in reduction of a capacitance between the electrodes in the discharge. And, since plasma ions are moved by the electric field, which is a characteristic of the hollow cathode discharge, impact on the fluorescent material by the ions are substantially reduced, reducing degradation of the fluorescent material.

SECOND EMBODIMENT

Different from the first embodiment in which the dielectric layer in the rear panel is etched in an arc form, the second embodiment implements the hollow cathode counter discharge of a PDP by etching a metal sheet in the rear panel. The PDP in accordance with the second embodiment of the present invention includes a front panel having an electrode formed on a front substrate, and a dielectric film and a protection film formed on an entire surface of the electrode in succession, and an address electrode on the protection film perpendicular to electrode and a rear panel having a metal sheet to a thickness on a rear substrate opposite to the front panel, a well region formed by etching the metal sheet to a depth, and a fluorescent material film formed on an inside surface of the well region. In the second embodiment, there is a transparent electrode formed on the front substrate, opposite to which the well region in the metal sheet on the rear substrate and the fluorescent material film in the well are formed.

Figure 4:
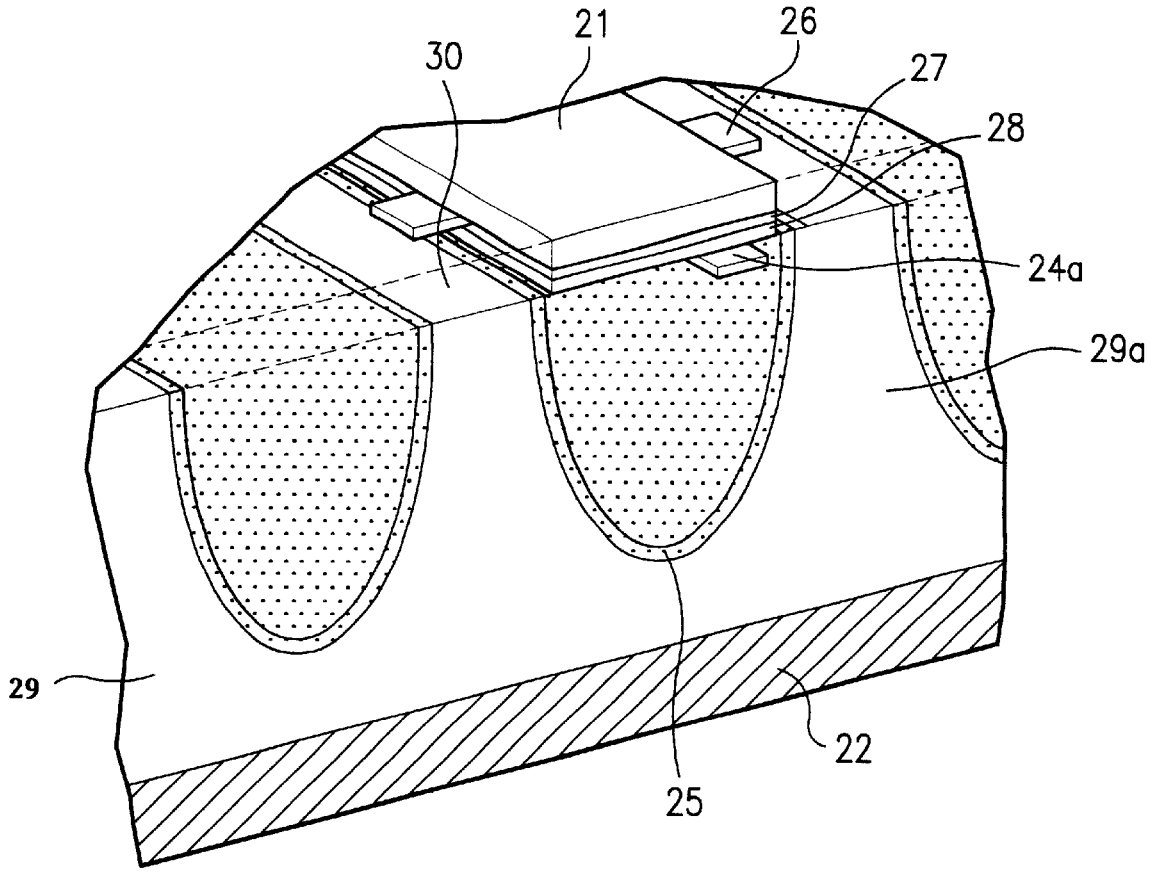
FIG. 4 illustrates a color plasma display panel in accordance with a second preferred embodiment of the present invention.

FIG. 4 illustrates a perspective view of key parts of cells of the hollow cathode type color plasma display panel in accordance with a second preferred embodiment of the present invention, referring to which, the second embodiment will be explained.

The hollow cathode type color plasma display panel in accordance with a second preferred embodiment of the present invention includes a front panel having a transparent electrode 26 disposed on a front substrate 21, a dielectric film 27 on an entire surface of the transparent electrode 26 for confining a discharge current, a protection film 28 on an entire surface of the dielectric film and an address electrode 24*a* on the protection film 28 perpendicular to the transparent electrode 26. The transparent electrode 26 is formed of indium oxide($InO_2$) or tin oxide ($SnO_2$) by thin film forming method, dipping method, or screen printing. The dielectric film 27 provided for generating a wall charge which drops a driving voltage is formed by depositing dielectric paste, and the protection film 28 is formed by depositing magnesium oxide(MgO) on the dielectric film 27. The metal sheet 29 is formed on a rear substrate 22. And, the metal sheet 29 on the rear substrate 22 is subjected to etching together with the rear substrate, up to a total depth of 10.000 $\mu$m, thereby forming a barrier 29*a* in the metal sheet. If it is required for improving an electric field characteristic and securing a large discharge space in a discharge cell, the thickness of the metal sheet 29 may be adjusted within a range. The address electrode 24*a* is formed of a metal thin film deposited on an inside surface of the well region and the barrier 29*a* in the metal sheet 29. A fluorescent material film 25 is formed in a metal on groove form between the barrier 29*a*. The fluorescent material film 25 is coated on an entire surface of the well region to a thickness, to complete a rear panel. The fluorescent material film 25 may also be formed by printing a fluorescent material paste composed of cellulose, acrylic resin and organic solvent(alcohol or ester) on a surface of the metal sheet 29 and baking at 400~600° C. The fluorescent material film 25 has a thickness of approx. 10~50 $\mu$m.

In the color PDP in accordance with a second preferred embodiment of the present invention, a hollow cathode counter discharge is occurred between the transparent electrode 26 and the address electrode 24*a* as, a target facing the transparent electrode 26 and the entire surface of the metal sheet 29 As the color PDP in the second embodiment utilizes a discharge between a transparent electrode 26 and the address electrode 24*a* and the metal sheet 29, ions which can be used in a glow region can be increased.

The principle of the hollow cathode counter discharge employed in the second embodiment is as follows. Upon a discharge initiation voltage is applied to the transparent electrode 26 and the address electrode 24*a*, electrons emitted from the address electrode 24*a* are activated to form a discharge glow region in the entire surface of the metal sheet 29. These electrons come from collisions of ions over the address electrode 24*a* and the metal sheet 29, and are accelerated outwardly from the glow discharge region to make collisions onto the fluorescent material film 25, to emit an UV ray while the electron are vanished The UV ray excites the fluorescent material film 25, to emit light, displaying colors of R, G, B. As a result, because the fluorescent material film 25 is excited by the UV ray emitted according to the hollow cathode counter discharge principle, the second embodiment allows to utilize an entire discharge cell as the discharge region. Eventually, a contrast and a luminance of the second embodiment is improved by approx. four times than the related art PDP. And, because the hollow cathode discharge is employed in which the address electrode and the metal sheet are used as a counter target, the second embodiment color PDP is involved in reduction of a capacitance between the electrodes in the discharge. And, since plasma ions are moved by the electric field, which is a characteristic of the hollow cathode discharge, impact on the fluorescent material by the ions are substantially reduced, reducing degradation of the fluorescent material.

As has been explained in detail up to now, the hollow cathode type color PDP in accordance with the second preferred embodiment of the present invention can maximize a discharge area, because the entire barrier of metal sheet makes a hollow cathode counter discharge against the address electrode, thereby allowing a favorable application to a gas discharge panel and the like satisfying all the requirements for a lifetime, a contrast, and a luminance applied to different displays. And, the hollow cathode type color PDP in accordance with the second preferred embodiment of the present invention can maximize a discharge area, increasing a luminance and dropping a discharge initiation voltage, as the PDP has the transparent electrode and the address electrode on the front panel, barriers formed by etching the metal sheet deposited on the rear substrate, and the fluorescent material film in the barriers. And, the hollow cathode type color PDP in accordance with the second preferred embodiment of the present invention can protect the fluorescent material film in the discharge cell effectively because the PDP is driven in a hollow cathode discharge utilizing the address electrode and the metal sheet as counter targets, which has a small capacitance between the electrodes.

THIRD EMBODIMENT

Figure 5:
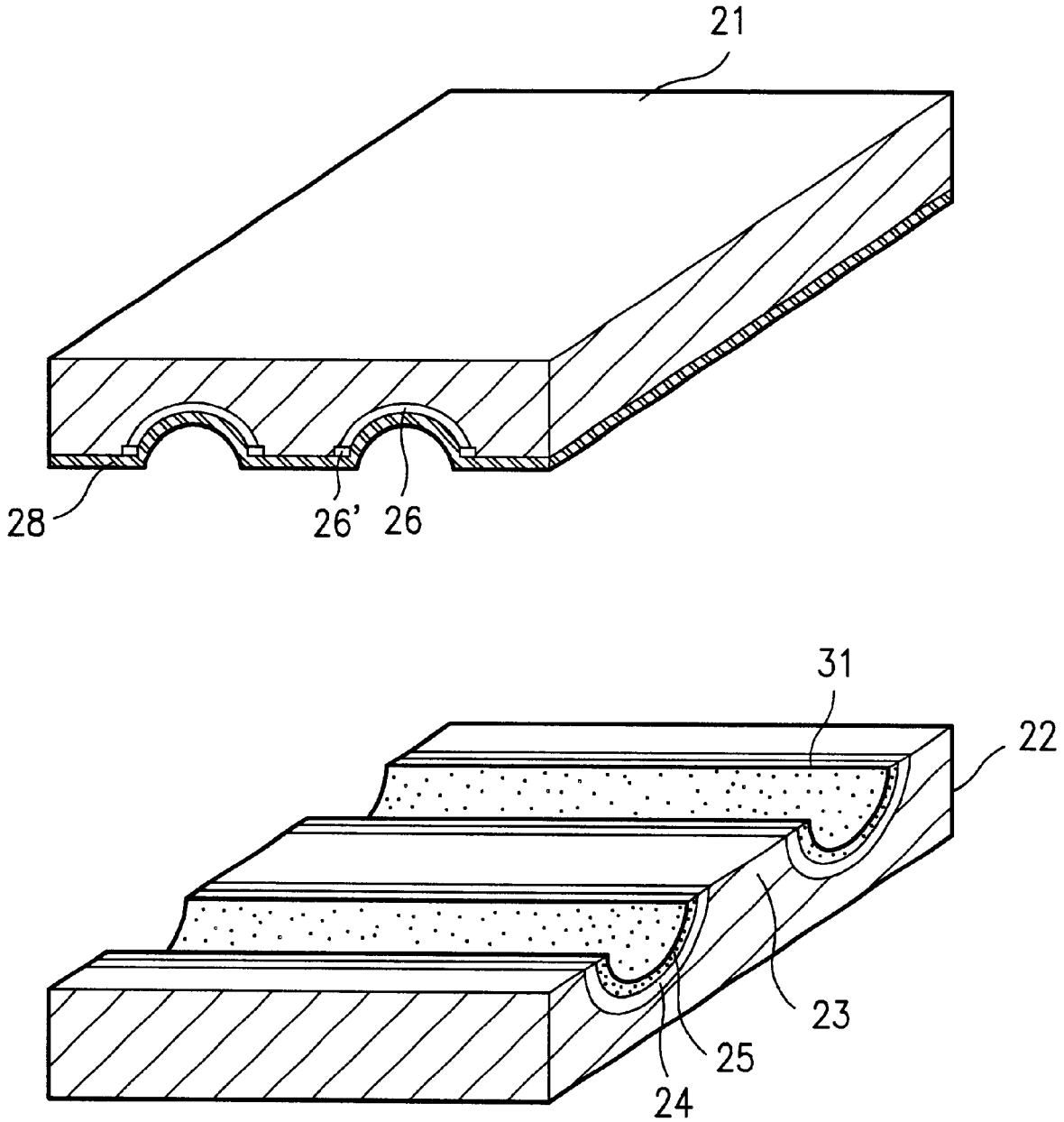
FIG. 5 illustrates a color plasma display panel in accordance with a third preferred embodiment of the present invention, and, FIG. 6 illustrates a color plasma display panel in accordance with a fourth preferred embodiment of the present invention.

The hollow cathode type color PDP in accordance with a third preferred embodiment of the present invention includes a front panel having grooves formed in a front substrate to a depth and a width, a plurality of transparent electrodes formed in the groove, and a dielectric film on an entire surface of the transparent electrode to a thickness for confining a discharge current, a rear panel having barriers formed by etching a rear substrate perpendicular to the transparent electrode in the front panel for making colors distinctive between adjacent cells, an address electrode formed on an inside surface of the barriers, and fluorescent material film and a protection film on an entire surface of the address electrode, Frit glass for bonding the front panel and the rear panel, and a mixture gas filled and sealed in a discharge region of cells. The hollow cathode type color PDP in accordance with the third preferred embodiment of the present invention is fabricated by forming grooves by etching the front substrate, forming a transparent electrode (ITO) in the groove in a form of arc, forming barriers by etching the rear substrate perpendicular to the transparent electrode, and forming the address electrode, the fluorescent material film, and the protection film stacked in the barrier in succession. FIG. 5 illustrates a perspective view of an entire structure of the hollow cathode type color plasma display panel in accordance with a third preferred embodiment of the present invention, referring to which, the third embodiment will be explained.

The hollow cathode type color plasma display panel in accordance with a third preferred embodiment of the present invention includes a front panel having grooves each formed in a front substrate 21 in a transverse direction to a depth and a width, a transparent electrode 26 and a bus electrode 26' formed in each of the grooves, and a dielectric film 27 formed on an entire surface of the transparent electrode 26. The transparent electrode has a curved or arc form and is in contact with the bus electrode 26'. The transparent electrode 26 is formed in the groove, of indium oxide($InO_2$) or tin oxide ($SnO_2$) by metal deposition, dipping, or screen printing. And, the bus electrode 26' is formed by photolithography, or more than two times of printing of a metal paste added with black pigment. And, the dielectric film 27, provided for generating a wall charge to drop a driving voltage, is formed by printing or depositing a dielectric paste and etching into an arc form. And, there is a rear panel having barriers 23 formed in a rear substrate 22 by etching regions of the rear substrate 22 perpendicular to the transparent electrode 26 formed in the front substrate 21, an address electrode 24 formed of a metal deposited on etched regions of the rear substrate 22 in the barriers 23, and a fluorescent material film 25 formed on an entire surface of the address electrode 24 to a thickness. The fluorescent material film 25 may also be formed by printing a fluorescent material paste composed of cellulose, acrylic resin and organic solvent(alcohol or ester) on a surface of the address electrode 24 and baking at 400~600. The fluorescent material film 25 has a thickness of approx. 10~50 $\mu$m. The protection film 29 is formed of magnesium oxide(MgO) deposited on the fluorescent material film 25 for protection of the fluorescent material.

The hollow cathode type color PDP in accordance with a third preferred embodiment of the present invention can be favorably applicable to a gas discharge panel satisfying all the requirements for a display of a lifetime, a contrast, and a luminance, because the easy induction of a counter discharge in the PDP while the PDP has an optical focusing structure allows to maximize a discharge area. And, the hollow cathode type color plasma display panel in accordance with a third preferred embodiment of the present invention has advantages in that the discharge area can be made large to the maximum extent for improving a luminance and keeping a discharge initiation voltage constant. And, the hollow cathode type color plasma display panel in accordance with the third preferred embodiment of the present invention is favorable for being of a highly defined one because the PDP is driven in a hollow cathode discharge which uses the address electrode as a counter target. In the aforementioned color PDP in accordance with a third embodiment of the present invention, a hollow cathode counter discharge is occurred between the transparent electrode 26 and the address electrode, a counter target of the transparent electrode 26. As a result, since the color PDP in the third embodiment utilizes a discharge between a transparent electrode 26 and the address electrode 24, ions which can be used in a glow region can be increased.

The principle of the hollow cathode counter discharge employed in the third embodiment is as follows. Upon a discharge initiation voltage is applied to the transparent electrode 26 and the address electrode 24, electrons emitted from the address electrode 24 are activated to form a discharge glow region. These electrons come from collisions of ions over the address electrode 24 and are accelerated outwardly from the glow discharge region to make collisions onto the fluorescent material film 25, to emit an UV ray while the electron are vanished. The UV ray excites the fluorescent material film 25, to emit light, displaying colors of R, G, B. As a result, because the fluorescent material film 25 is excited by the UV ray emitted according to the hollow cathode counter discharge principle, the third embodiment allows to utilize an entire discharge cell as the discharge region. Eventually, a contrast and a luminance of the third embodiment is improved by approx. four times than the related art PDP.

FOURTH EMBODIMENT

In this fourth embodiment, Frit seal is provided on the barriers in addition to the third embodiment for maximizing a sealing effect between the discharge cells.

Figure 6:
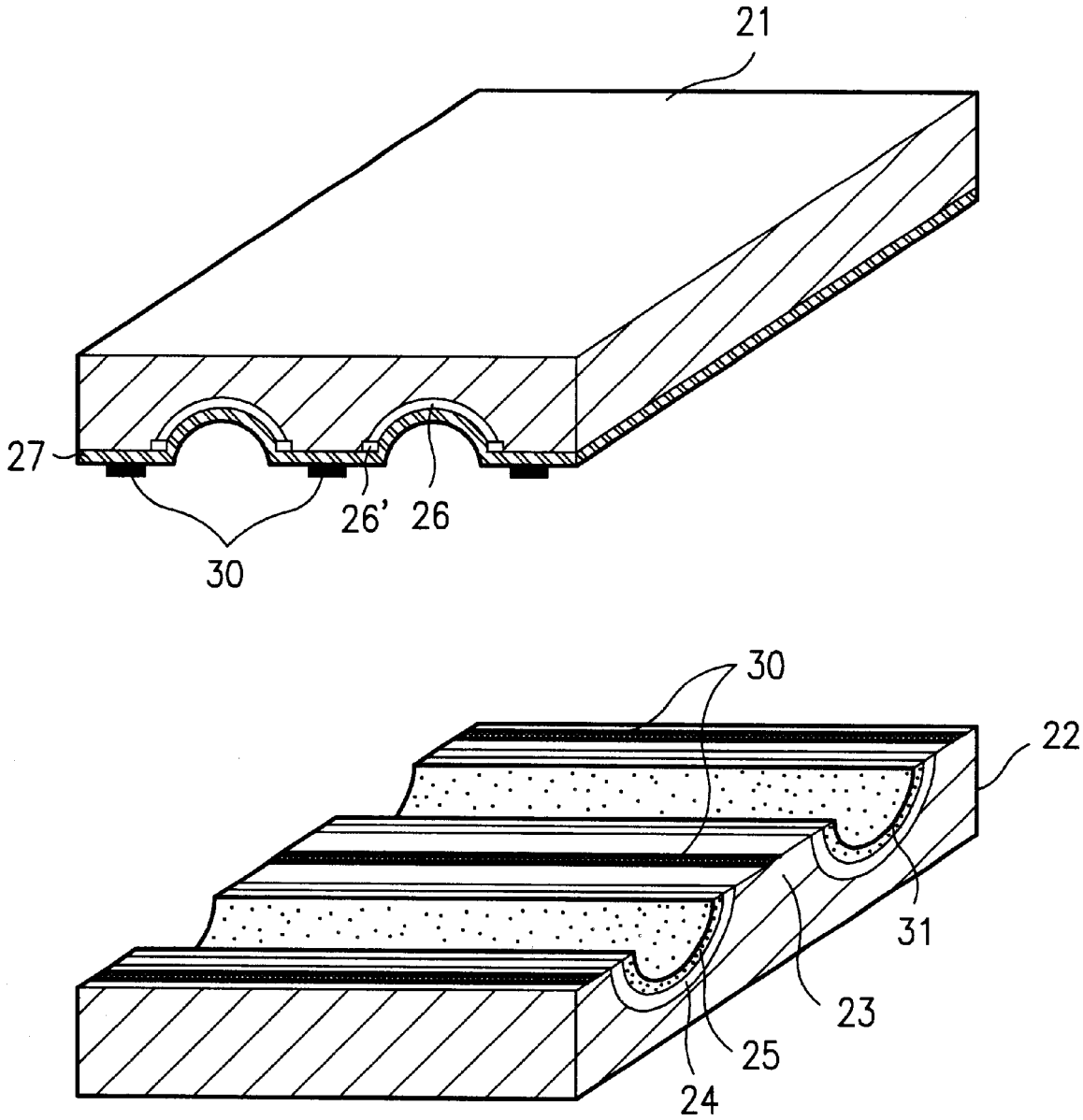

The hollow cathode type color PDP in accordance with a fourth preferred embodiment of the present invention includes a front panel having grooves formed in a front substrate to a depth and a width, a plurality of transparent electrodes formed in the groove, and a dielectric film on an entire surface of the transparent electrode to a thickness for confining a discharge current, a rear panel having barriers formed by etching a rear substrate opposite to the transparent electrode in the front panel for making colors distinctive between adjacent cells, an address electrode formed on an inside surface of the barriers, and fluorescent material film on an entire surface of the address electrode, and Frit glass provided not only on sealing regions of the rear panel but also on top of barriers on the front/rear substrate. the hollow cathode type color PDP in accordance with the fourth preferred embodiment of the present invention is fabricated by forming grooves by etching the front substrate, forming a transparent electrode(ITO) in the groove in a form of arc, forming barriers by etching, the rear substrate opposite to the transparent electrode, forming the address electrode, and the fluorescent material film stacked in the barrier in succession, and bonding the front substrate and the rear substrate by vacuum fusion welding with Frit seal. FIG. 6 illustrates a perspective view of an entire structure of the hollow cathode type color plasma display panel in accordance with the fourth preferred embodiment of the present invention, referring to which, the fourth embodiment will be explained.

The hollow cathode type color plasma display panel in accordance with a fourth preferred embodiment of the present invention includes a front panel having grooves each formed in a front substrate 21 in a transverse direction to a depth and a width, a transparent electrode 26 and a bus electrode 26' formed in each of the grooves, and a dielectric film 27 formed on an entire surface of the transparent electrode 26 to a thickness for confining a discharge current. The transparent electrode 26 has a curved form and is in contact with the bus electrode 26'. The transparent electrode 26 is formed in the groove, of indium oxide($InO_2$) or tin oxide ($SnO_2$) by metal deposition, dipping, or screen printing. And, the bus electrode 26' is formed as a metal thin film by photolithography, or more than two times of printing of a metal paste added with black pigment to a desired size. And, the dielectric film 27, provided for generating a wall charge to drop a driving voltage, is formed by printing or depositing a dielectric paste and etching into an arc form. And, there is a rear panel having barriers 23 formed in a rear substrate 22 by etching regions of the rear substrate 22 perpendicular to the transparent electrode 26 formed in the front substrate 21, an address electrode 24 formed of a thin metal deposited on etched regions of the rear substrate 22 in the barriers 23. The address electrode 24 is formed in a form of metal on groove between the barriers 23. And, a fluorescent material film 25 is formed on an entire surface of the address electrode 24 to a thickness by electrophoiesis, and an MgO protection film on the fluorescent material film 25. The fluorescent material film 25 may also be formed by printing a fluorescent material paste composed of cellulose, acrylic resin and organic solvent(alcohol or ester) on a surface of the address electrode 24 and baking at 400~600. The fluorescent material film 25 has a thickness of approx. 10~50 $\mu$m. The protection film 29 is formed of magnesium oxide(MgO) deposited on the fluorescent material film 25 for protection of the fluorescent material. A Frit seal is screen printed on top of the barriers 23. The front, and rear substrates 21 and 22 with the Frit seal printed are baked in a furnace at approx. 400~500° C. to bond the substrates 21 and 22 with the Frit seal, together. The Frit seal 30 in the sealing region of the rear substrate 22 is formed of any one of lead monoxide(PbO), zinc oxide(ZnO), boron oxide ($B_2O_3$), silicon oxide($SiO_2$), aluminum oxide($Al_2O_3$), and zirconium oxide($ZrO_2$). Air in the discharge cells are evacuated before the welding of the front, and rear panels of the display panel to assure a positive vacuum fusion welding, ane the discharge cells should be sealed after an inert mixture gas of neon Ne, helium He, and xenon Xe are filled therein. The gas in the discharge cell has a pressure of 400~550 Torr, lower than the atmospheric pressure, and the performance of the PDP is the better as the gas pressure in the discharge cell is the higher.

In the color PDP in accordance with the fourth preferred embodiment of the present invention, a hollow cathode counter discharge is occurred between the transparent electrode 26 and the address electrode, a target facing the transparent electrode 26. As the color PDP in the fourth embodiment utilizes a discharge between a transparent electrode 26 and the address electrode 24, ions which can be used in a glow region can be increased.

The principle of the hollow cathode counter discharge employed in the fourth embodiment is as follows. Upon a discharge initiation voltage is applied to the transparent electrode 26 and the address electrode 24, electrons emitted from the address electrode 24 are activated to form a discharge glow region. These electrons come from collisions of ions over the address electrode 24 and are accelerated outwardly from the glow discharge region to make collisions onto the fluorescent material film 25, to emit an UV ray while the electron are vanished. The UV ray excites the fluorescent material film 25, to emit light, displaying colors of R, G, B. As a result, because the fluorescent material film 25 is excited by the UV ray emitted according to the hollow cathode counter discharge principle, the fourth embodiment allows to utilize an entire discharge cell as the discharge region. Eventually, a contrast and a luminance of the first embodiment is improved by approx. four times than the related art PDP.

As has been explained in detail, the color PDP in accordance with the fourth preferred embodiment of the present invention can moderate the non-uniformity of the discharge voltage and allows to prevent cracking of sealing region over the panel even if a high pressure gas is filled, because the Frit seal is coated, not only on the sealing region used in the related art color PDP, but also on top of barriers in the front/rear panel before bonding the front, and rear panels.

It will be apparent to those skilled in the art that various modifications and variations can be made in the hollow cathode type color plasma display panel of the present invention without departing from the spirit or scope of the invention. Thus, it is intended that the present invention cover the modifications and variations of this invention provided they come within the scope of the appended claims and their equivalents.

What is claimed is:

1. A hollow cathode type color plasma display panel comprising:

a front panel having an electrode, a first dielectric film and a protection film which are formed on a front substrate; and, a rear panel having a second dielectric film formed on a rear substrate, a well region formed in the second dielectric film, the well region having a prescribed depth less than the depth of the second dielectric film, and an address electrode and a fluorescent material film which are formed in succession on an inside surface of the well region.

2. A hollow cathode type color plasma display panel as claimed in claim 1, wherein the electrode is provided for making a counter discharge to the address electrode.

3. A hollow cathode type color plasma display panel as claimed in claim 2, wherein the electrode is transparent.

4. A hollow cathode type color plasma display panel as claimed in claim 1, wherein the second dielectric film is formed of a barrier material of a low melting, point glass containing lead dioxide($PbO_2$).

5. A hollow cathode type color plasma display panel as claimed in claim 1, wherein the well region has a curved shape, which is formed with the second dielectric film.

6. A hollow cathode type color plasma display panel as claimed in claim 1, wherein the second dielectric film serves as a barrier material, and the second dielectric film and the rear substrate are different materials.

7. A hollow cathode type color plasma display panel comprising:

a front panel having electrodes, a first dielectric film and a protection film, which are formed in succession on a front substrate, and an address electrode formed on the protection film perpendicular to the electrodes.

8. A hollow cathode type color plasma display panel as claimed in claim 7, further comprising a protection film formed on the fluorescent material film in the rear panel.

9. A hollow cathode type color plasma display panel as claimed in claim 7, further comprising a rear panel having a plurality of curved shaped discharged well regions formed in a metal sheet on a substrate.

10. A hollow cathode type color plasma display panel comprising:

a rear panel having a metal sheet formed on a rear substrate, a plurality of barriers formed within the metal sheet, each barrier being formed to a prescribed depth of a recess, wherein the depth of the recess is less than the depth of the metal sheet, and a fluorescent material film coated on an inside wall of each barrier.

11. A hollow cathode type color plasma display as claimed in claim 10, wherein the recess has a curved shape.

12. A hollow cathode type color plasma display panel as claimed in claim 11, wherein the barrier has the prescribed depth of more than 10,000 $\mu$m into the metal sheet.

13. A hollow cathode type color plasma display panel as claimed in claim 10, further comprising a front panel having a plurality of electrodes, a plurality of address electrodes, and a dielectric film and a protection film formed in succession on a front substrate, wherein each of the plurality of address electrode is formed on the protection film perpendicular to the plurality of electrodes.

14. A hollow cathode type color plasma display panel comprising:

a front panel having a transparent electrode, a first dielectric film and a protection film which are formed in succession on a front substrate, and an address electrode formed on the protection film perpendicular to the transparent electrode; and, a rear panel having a metal sheet formed on a rear substrate a plurality of barriers formed in the metal sheet, each barrier being formed to a prescribed depth of a recess, and a fluorescent material film on an inside surface of each barrier.

15. A hollow cathode type color plasma display panel as claimed in claim 16, wherein the recess is formed within the metal sheet.

16. A high pressure discharge type color plasma display panel comprising:

a front panel having grooves formed in a front substrate, each groove having a prescribed depth and a prescribed width, wherein the depth of each groove is less than the depth of the front substrate, a plurality of electrodes formed in the grooves, a dielectric film formed on the electrode, and a plurality of first barriers formed in the same direction to the electrodes; and a rear panel having a plurality of second barriers formed in a rear substrate opposite to the electrode in the front panel, an address electrode formed on an inside surface of the barrier, and a fluorescent material film on the rear substrate.

17. A high pressure discharge type color plasma display panel as claimed in claim 16, wherein the substrates are vacuum fusion welded with the Frit seal on regions of top of the first, and second barriers.

18. A high pressure discharge type color plasma display panel as claimed in claim 16, wherein Frit seal is formed of any one of lead monoxide(PbO), zinc oxide(ZnO), boron oxide($B_2O_3$), silicon oxide($SiO_2$), aluminum oxide($Al_2O_3$), and zirconium oxide($ZrO_2$).

19. A high pressure discharge type color display panel as claimed in claim 16, wherein the dielectric film is formed on the entire surface of the electrode to a prescribed thickness.

20. A high pressure discharge type color display panel as claimed in claim 16, wherein the grooves have a curved shape.

21. A high pressure discharge type color display panel as claimed in claim 16, wherein the plurality of second barriers are formed by etching the rear substrate opposite the electrode in the front panel for making colors distinctive between adjacent cells.

22. The plasma display panel as claimed in claim 16, wherein Frit seals are on regions on top of the first and second barriers.

23. A plasma display panel, comprising:

a front panel having an electrode, a first dielectric film and a protection film which are formed on a front substrate; and a rear panel having a metal sheet formed on a rear substrate, a plurality of recesses formed in the metal sheet to form a plurality of barriers defining a plurality of discharge spaces and a fluorescent material being formed within each recess, wherein the depth of each of the plurality of recesses is less than the depth of the metal sheet.

24. The plasma display panel as claimed in claim 23, wherein each recess is formed within the metal sheet.

25. The plasma display panel as claimed in claim 23, further comprising an address electrode on the front panel.

26. The plasma display panel as claimed in claim 23, further comprising an address electrode on the rear panel.

27. The plasma display panel as claimed in claim 23, wherein the rear panel has the second dielectric film formed on the rear substrate, and wherein the second dielectric film and the rear substrate are different materials.

* * * * *